United States Patent [19]

Jenkins

[11] Patent Number: 4,830,269

[45] Date of Patent: May 16, 1989

[54] TWO-PART MAILER WITH TOP-OPENING RETURN ENVELOPE

[75] Inventor: Richard A. Jenkins, Wheeling, Ill.

[73] Assignee: Moore Business Forms, Inc., Glenview, Ill.

[21] Appl. No.: 167,183

[22] Filed: Mar. 11, 1988

[51] Int. Cl.[4] ..... B65D 27/06

[52] U.S. Cl. ..... 229/73; 229/69

[58] Field of Search ..... 229/73, 69, 70, 71, 229/68 R

[56] References Cited

U.S. PATENT DOCUMENTS

| | | | |
|---|---|---|---|
| 2,710,716 | 6/1955 | Deutschmeister et al. | 229/73 |
| 3,312,385 | 4/1967 | Amort | 229/73 |
| 3,428,237 | 2/1969 | Dowen | 229/73 |
| 3,531,046 | 9/1970 | Carrigan | 229/73 |
| 3,833,167 | 9/1974 | Kapitan | 229/73 |
| 3,952,942 | 4/1976 | O'Leary et al. | 229/73 |
| 3,981,435 | 9/1976 | Johnsen | 229/73 |
| 4,055,294 | 10/1977 | Traise | 229/73 |
| 4,148,430 | 4/1979 | Drake | 229/73 |
| 4,524,903 | 6/1985 | Vath | 229/73 |
| 4,632,427 | 12/1986 | Angus | 229/73 |
| 4,709,850 | 12/1987 | Wagner | 229/73 |
| 4,715,530 | 12/1987 | Leese et al. | 229/73 |

*Primary Examiner*—Willis Little

*Attorney, Agent, or Firm*—Cushman, Darby & Cushman

[57] ABSTRACT

A method is practiced to provide an outgoing mailer, parts of which are used to provide a return envelope. A feature of particular interest is that both the face and the back of the return envelope and face of the outgoing envelope are formed from the same web of paper. The article in its outgoing form has a top or face web with a window near its lower right corner, through which a variable address is viewed. A return address may be provided at the upper left corner, and postage at the upper right corner. Under the top face an intermediate web portion exists, which is an extension of the top web folded back nearer its own left edge and doubled against a corresponding segment of the top face. The intermediate web portion is of limited length, so that it does not cover the window. Finally, a bottom web underlies the top face and intermediate web portion, and is of length equal to the top web. The variable address is placed on the bottom web in position to be viewed through the window. Rows of dots of adhesive are placed along the top and bottom edges of the rear surfaces of the top web to hold the intermediate web portion and bottom web to the face portion of the top web. Various perfed lines of weakness exist in the two webs. When the original mailer is received by the addressee (e.g. "John M. Jones") he/she opens it by tearing off the end areas along vertical perf lines, and then peeling the top web from the bottom web (the dots of adhesive above and below the window area release for this purpose). The user is then left with a return envelope (from which he or she will detach the vestigial windowed section of the top face) and the now separate bottom web. The face and rear of the return envelope are held together by a glue line extending around the margins of the return envelope other than the open edge. A rewettable glue flap is provided on the intermediate web for closing the return envelope. The address of the party to receive the return envelope is printed on the back of the intermediate web portion. This will also leave the same address (e.g. "Moore Business Forms") in an upper corner on the back of the return envelope (if it was on the outgoing envelope).

18 Claims, 3 Drawing Sheets

Fig. 3
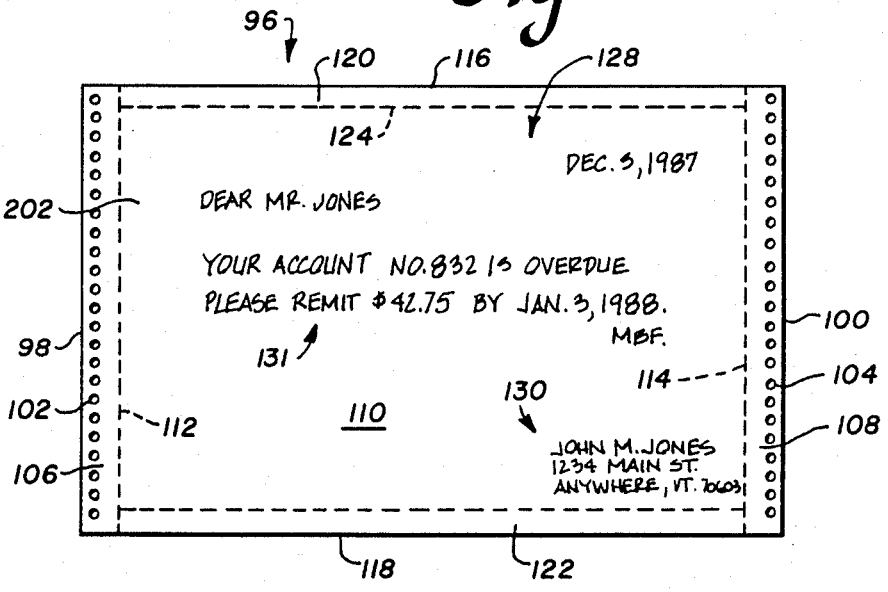
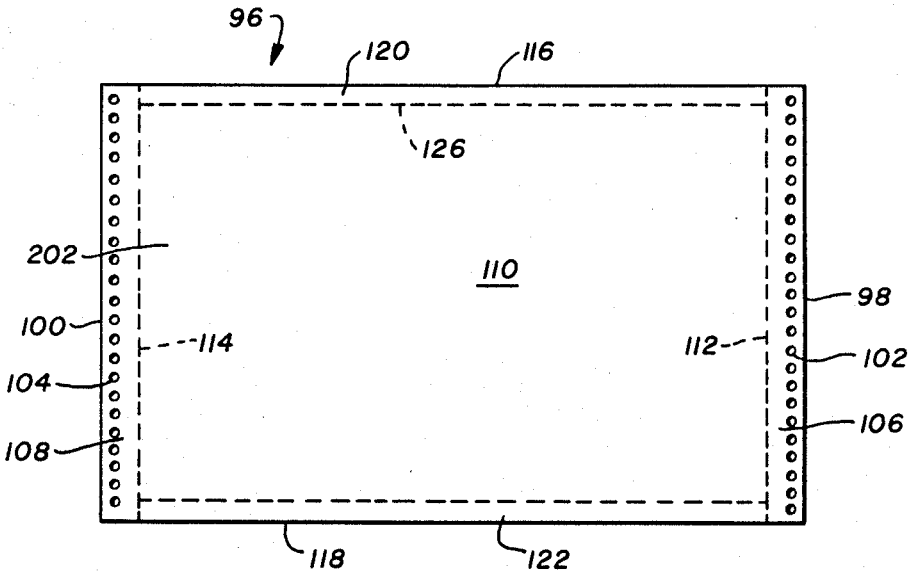
Fig. 4

TWO-PART MAILER WITH TOP-OPENING RETURN ENVELOPE

BACKGROUND OF THE INVENTION

Several methods have been attempted to manufacture a non-impact printer-compatible mailer-type of business form with a top-opening return envelope. The concept heretofore used has been to create a two-part web, containing a wide and a narrow sheet, heat seal spot pasted on the removal stub areas, and pocket pasted to create a return envelope. The wide web, part 1, has contained a glassine patch over a die-cut window, thus allowing the outgoing address to appear. The back of the two-part web has contained heat seal adhesive in a full perimeter pattern. Part 2, imaged by a laser or impact printer, has contained stub removal perforations, but no heat seal adhesive.

The problem in manufacturing this product is ensuring proper alignment ($\pm 1/64''$) from part-to-part of the removal perforations. Since these perforations on the two-part web are put on at the collator, and the corresponding perforations for the imaged sheet (i.e. the variably-printed sheet) are put on at the press, two different perforation units are used, and perf alignment has been very difficult to guarantee.

The problem with the heretofore conventional manufacturing method has been to match the perfs (form depth and sub removal) applied on one sheet at press, with the perfs on the two-part pasted set applied at the collator.

SUMMARY OF THE INVENTION

A method is practiced to provide an outgoing mailer, parts of which are used to provide a return envelope. A feature of particular interest is that both the face and the back of the return envelope are formed from one web of paper. The article in its outgoing form has a top or face web with a window near its lower right corner, through which a variable address is viewed. A return address may be provided at the upper left corner, and postage at the upper right corner. Under the top face an intermediate web portion exists, which is an extension of the top web folded back nearer its own left edge and doubled against a corresponding segment of the top face. The intermediate web portion is of limited length, so that it does not cover the window. Finally, a bottom web underlies the top face and intermediate web portion, and is of length equal to the top web. The variable address is placed on the bottom web in position to be viewed through the window. Rows of dots of adhesive are placed along the top and bottom edges of the rear surfaces of the top web to hold the intermediate web portion and bottom web to the face portion of the top web. Various perfed lines of weakness exist in the two webs. When the original mailer is received by the addressee (e.g. "John M. Jones") he/she opens it by tearing off the end areas along vertical perf lines, and then peeling the top web from the bottom web (the dots of adhesive above and below the window area release for this purpose). The user is then left with a return envelope (from which he or she will detach the vestigial windowed section of the top face) and the now separate bottom web. The face and rear of the return envelope are held together by a glue line extending around the margins of the return envelope other than the open edge. A rewettable glue flap is provided on the intermediate web for closing the return envelope. The address of the party to receive the return envelope is printed on the back of the intermediate web portion. This will also leave the same address (e.g. "Moore Business Forms") in an upper corner on the back of the return envelope (if it was on the outgoing envelope).

The principles of the invention will be further discussed with reference to the drawings wherein a preferred embodiment is shown. The specifics illustrated in the drawings are intended to exemplify, rather than limit, aspects of the invention as defined in the claims.

BRIEF DESCRIPTION OF THE DRAWINGS

In the Drawings

FIG. 3 is a front elevation view of the front face of the second part of the mailer of the present invention;

FIG. 4 is a rear elevation view showing the rear face thereof;

DETAILED DESCRIPTION

Figure 1:
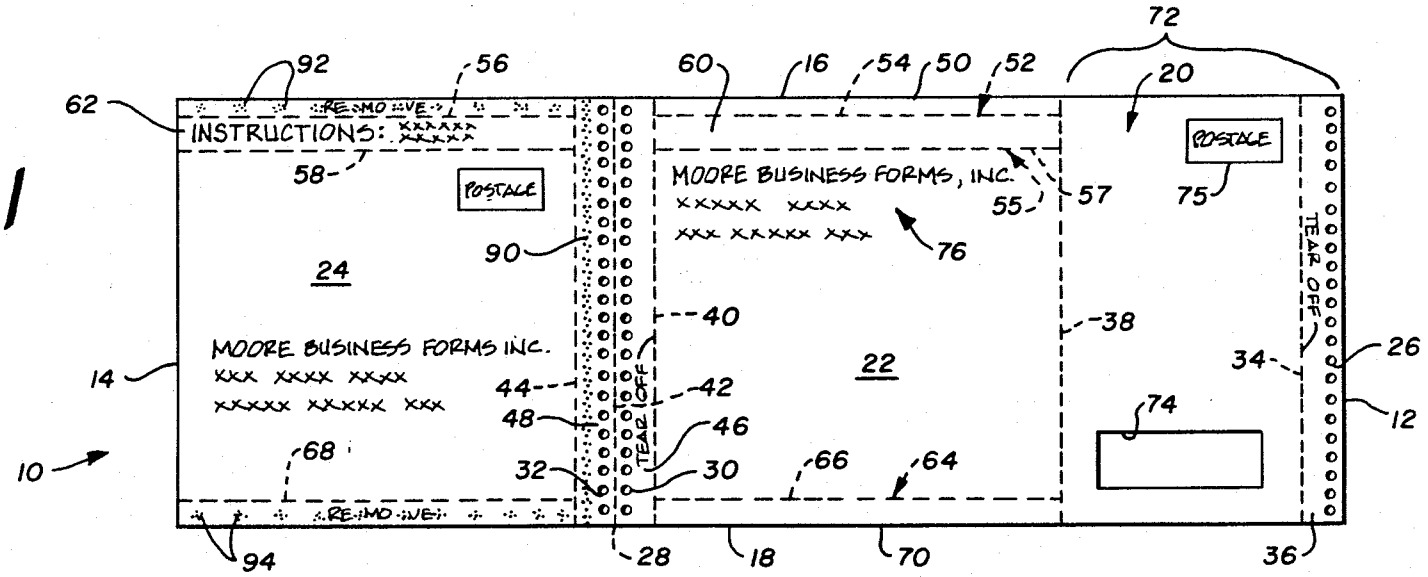
FIG. 1 is a front elevation view of the front face of the first part of a mailer of the present invention.

The term 'perf' is an art-used term referring to a line of perforation which is a species of a line of weakness (or weakening).

Although a single mailer and its parts are shown in the drawings, it should be apparent that the mailer of the invention preferably is manufactured from paper web-stock of indeterminate length, which is severed along successive form-dividing transverse lines of weakness, in order to divide the composite stock of indeterminate length into a plurality of individualized communications.

The terms "longitudinal" and "length" are used to denote the direction on the form parts that is parallel to the length of the web from which the respective form part was made, and the terms "transverse" and "width" are used to denote the direction at right angles thereto, which extended crosswise of the web stock.

Most often, the mailer stock, a manufactured, is maintained in composite web form, and shipped to the manufacturer's customer, generally as Z-folded web stock of indeterminate length, although it could be furnished on rolls. The manufacturer's customer runs the web stock through a completion line for printing variable information on the second part, putting parts 1 and 2 together and sealing them, and successively severing leading increments from the thus-created composite web to provide individual mailers, ready to be mailed. The current preference is for the variable information to be printed on the second part of the mailer using a non-impact printer, e.g. a computer operated laser/ ink-jet type of non-impact printer, such devices being readily commercially available.

(Because part 1 of the mailer is folded part-way back on itself along a longitudinal fold line, whether a particular face of that part is its front face or its rear face is a somewhat academic question. For convenience in description, the orientation of the wider, top face, portion of the first part, in the outgoing mailer, has been used as the basis for designating "front" and "rear", the face which forms the front of the outgoing envelope being designated its "front" or "outer" face, and the opposite face its "rear" or "inner" face.)

Referring first to FIG. 1, the first part (sometimes referred to as part 1) of the mailer is shown at 10, being a full width segment of paper web having a longitudinally extending right edge 12, a longitudinally extending left edge 14, a transversally extending top edge 16 (which once was a corresponding line of weakness running widthwise of a web of paper stock having indeterminate length) and a transversally extending bottom edge 18 (which once was a corresponding line of weakness running widthwise of the same web of paper stock).

The outer face 20 of the first form part 10 will provide both the front face 22 of an outgoing envelope, and, later, the front face 24 of a return envelope.

While it was still in web form, the web which has become part 1 of the form was provided along its right edge 12 (the terms "left" and "right" being designated in relation to the front face of each web) with a longitudinal row of sprocket pin-receiving holes 26, and, at an intermediate site that is located to the left of the imaginary longitudinal centerline of the corresponding web (e.g. at an intermediate location corresponding approximately to an imaginary one-third/two-thirds longitudinal dividing line, immediately to the right and to the left of what will later become a longitudinal fold line 28), the web for part 1 is provided with additional longitudinal rows 30, 32 of sprocket pin-receiving holes. The rows of holes 26, 30 and 32 preferably are simultaneously provided, with holes in all of them being correspondingly located, widthwise of the sheet.

In relation to a mailer, the part 1 increment that will form a part of that mailer is full depth (i.e. full length), in the sense that the edges 16, 18 will also form corresponding portions of the top and bottom edges of the outgoing mailer.

The first part 10 is shown further provided with five full-depth longitudinal lines of weakness (a generic term which includes the species of a row of perforation holes or slits), including, starting at the right, a first row 34 which is located more medially than, but adjacent, the row of sprocket holes 26 so as to define a right marginal strip 36; an intermediate, second row 38 which will define the border between a return envelope and a window-bearing discard portion of the first part; a third row 40, located more medially than, but adjacent, the row of sprocket holes 30; a fourth row 42 which coincides with and aids in defining the longitudinal fold line 28; and a fifth row 44, located more laterally than but adjacent the row of sprocket holes 32. The third and fourth rows 40, 42 define between them a potential marginal strip 46 on which the row of sprocket holes 30 is provided intermediate the width of such strip, and the fourth and fifth rows 42, 44 define between them a potential marginal strip 48 on which the row of sprocket holes 32 is provided intermediate the width of such strip.

The increment of part 10 is further shown having a plurality of transversally extending lines of weakness, including (starting from the top) a first one 50 (now severed), which extends full width along the top edge 16, helping to define the line along which the increment became severed from the web. A second one, 52, spaced a short distance below the top edge 16, but continuous only in two segments, one, 54, between the second longitudinal perforation line 38 and the third longitudinal perforation line 40, and another, 56, between the fifth perforation line 44 and the left edge 14 of the web which provides part 10, thus defining respective plies of what will become an upper marginal strip for an outgoing envelope. The next lower horizontally extending line of weakness is the third line 55, which extends between the same terminii as the line 52, but spaced therebelow a short distance, in segments 57, 58 which will respectively provide a removable flap 60 and a glue flap 62 (which later will be folded over on the line 58 for closing and sealing the return envelope).

Near, but above, the bottom 18 edge by about as much as the line 52 is below the top edge 16, a fourth horizontal line of weakness 64 is provided, again in two segments 66, 68 between the same terminii as the line 52, in order to provide with the bottom edge 18 respective plies of what Will become corresponding parts of a lower marginal strip for the outgoing envelope. Finally, a fifth horizontal line of weakness is provided at 70, coincident with and helping to define the location of the bottom edge 18.

The discard panel 72 of the front face of the outgoing envelope shown provided, centered left-to-right in such panel, but low on the sheet, near the lower marginal strip, with a diecut window, cut using a conventional technique, to provide an aperture 74 through which a send-to address variably printed on the front of the second part of the mailer at a later stage will be able to be read as the outgoing mailer is being handled in the mails and delivered to the addressee.

Figure 2:
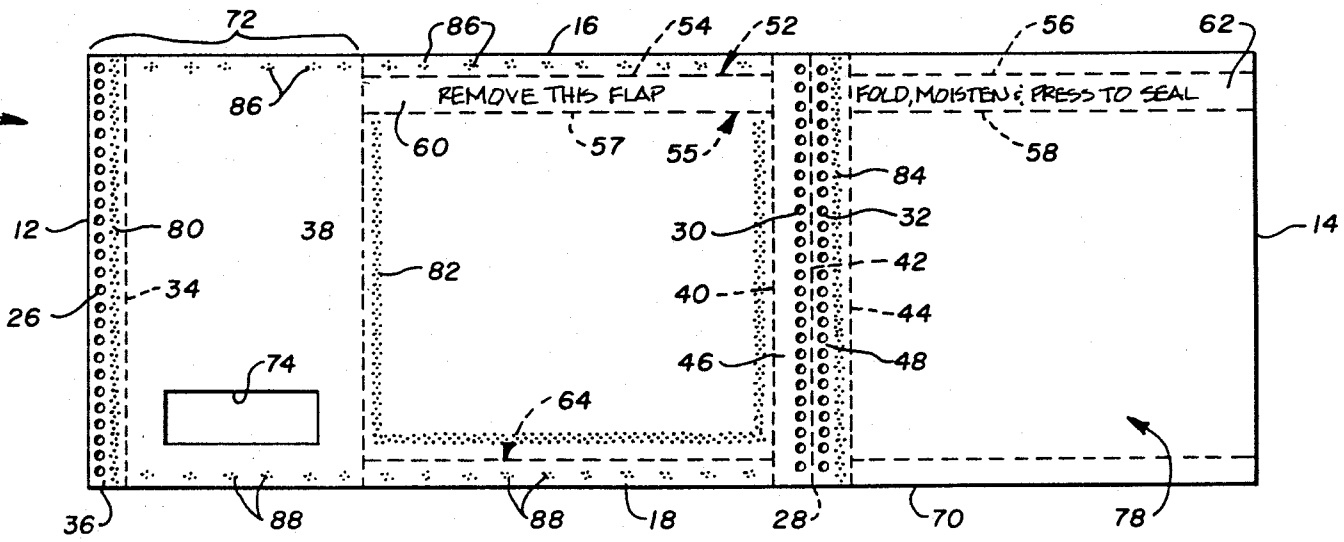
FIG. 2 is a rear elevation view showing the back face thereof.
Figure 5:
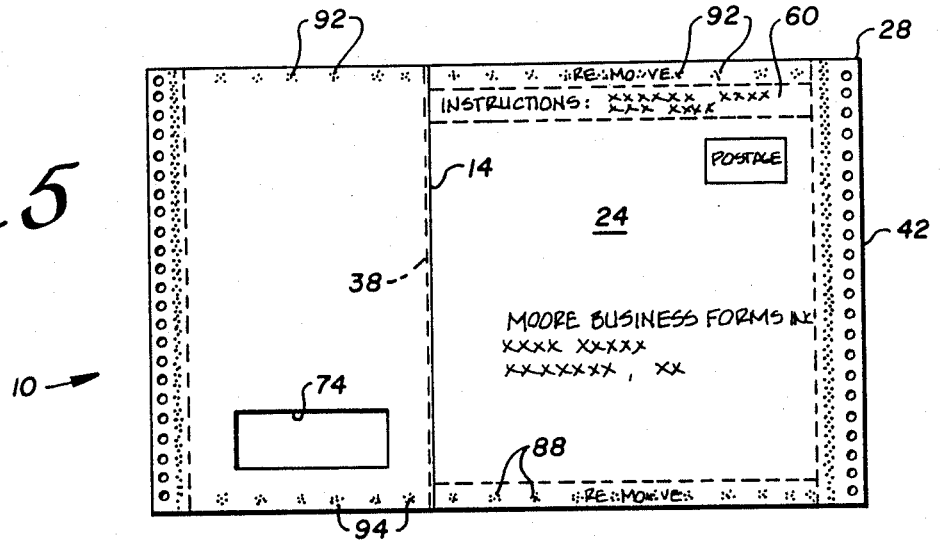
FIG. 5 is a rear elevation view of the first part of the mailer of the present invention, after the part has been folded about a longitudinal fold line.

By preference, the window aperture 74 is unglazed, although it may be conventionally glazed by pasting a glassine patch or the like to a glue-line (not shown) extending around the perimeter of the aperture 74 on the face which is shown in FIG. 2.

The front face 20 of the first part 10 is shown further provided, e.g. by the form manufacturer, while the part 1 is still in web form and not yet folded on the line 28, with a plurality of fields of non-varying printing, e.g. a frank mark or "apply postage here" field 75 at what will become the upper right corner of the front face 22 of the outgoing envelope (more medial than the perforation line 34), a return address field 76 at what will become the upper left corner of the outgoing envelope, but between the second and third longitudinal perforation lines 38 and 40 and below the removable flap 60.

Instructions for instructing the user to open the outgoing envelope by tearing off its left and right, and possibly its top and bottom marginal strips, may be printed on the outside of the outgoing envelope at any convenient location.

Referring now to FIG. 2, the rear face 78 of the first part 10 of the mailer may be provided with various glue lines of various types, including (beginning at the left), a first longitudinally streamed glue line 80 running along the right marginal strip 36, e.g. between the row of sprocket holes 26 and the first longitudinal perforation line 34; an upwardly-opening squared U-shaped band of adhesive 82 running inside the second and third longitudinal lines of perforations 38, 40 and above the fourth horizontal line of perforations 64 in order to define the left, right and bottom extent of the interior of a return envelope; and a second longitudinally streamed glue line 84 running along what will become the left marginal strip of the outgoing envelope for sealing together the two plies thereof which are contributed thereto by the first part 10 of the form stock. This glue line 84 is sited to seal the marginal strip 46 to the marginal strip 48.

In a preferred embodiment, the part 1 is about 19–19.5 inches wide, the second longitudinal perforation line 38 is located about 4.25–4.5 inches from the left edge 14, and the depth of an increment (i.e. the top edge to bottom edge dimension of one outgoing mailer) is about 5½ inches.

Glue (a generic term used synonymously herein for adhesive), is also provided in an upper transverse row of spots on the upper transverse marginal strip of the back (inner) face of the outgoing envelope at 86, at least between the first and third longitudinal lines of weakness, and in a second row of spots 88 on a comparable segment of the lower transverse marginal strip.

Referring again briefly to FIG. 1, a longitudinally extending glue line 90 is provided on the rear face of the potential marginal strip 48, at a location comparable to the location of the longitudinal glue strip on its opposite face, and upper and lower horizontal rows 92, 94 of spots of adhesive are provided on the upper and lower transverse marginal strips at locations comparable (heightwise) to the rows 86, 88 on the opposite face.

Turning now to FIGS. 3 and 4 part 2, the second part 96 of the mailer is a simpler structure in that it has no glue lines and no diecut apertures. This part is formed from a respective increment of a web of paper of indeterminate length. It is narrower than the first part 10, its width comparing to the distance transversally of the first part 10 from the right edge 12 to the longitudinal fold line 28, or, actually, very slightly short of that line, and it is likewise of full depth.

Referring to FIG. 3, the second part 96 has a left edge 98 and a right edge 100, left and right marginal rows of sprocket holes 102, 104, provided on left and right marginal strips 106, 108 distinguished from the main panel 110 by left and right marginal longitudinal perforation lines 112, 114.

Further, the second part 96 has a horizontal top edge 116, a horizontal bottom edge 118, an top and bottom marginal strips 120, 122 distinguished from the main panel 110 by top and bottom marginal perforation lines 124, 126 which extend between the perforation lines 112 and 114.

Thicknesswise of the completed mailer, the rows of sprocket holes and perforation lines on this part 2, 96, match in location as nearly as feasible the apparently comparably located rows of holes and perforation lines of part 1, 10.

It is the inner face 128 of the main panel 110 of the second part 96 of the mailer on which the customer of the forms manufacturer prints variable printing, e.g. a name and address 130 in a block located where it will become visible through the window of the front of the outgoing envelope, plus potentially other information (generally indicated at 131), e.g. as to the status of an account of the person whose name appears in block 130. (As mentioned above, the variable printing on the face 128 preferably is done while the second part 96 is still in indeterminate-length web form, in order to facilitate similarly personalizing a long series of communications.)

The process and product of the invention are versatile, in the sense that the process may be used to manufacture the cover sheet (part 1) in such a manner that the outgoing and return envelope are produced from one web of paper, part 1, which is plow-folded at a point coinciding with the width of the printer sheet, part 2. This ensures that all perfs may be applied on press, so that perf matches can be maintained, and tolerances of ± 1/64" can be maintained. The fold at 28 can be accomplished at time of manufacturing, by applying a cold melt, pasted pocket glue pattern on the collator, or the forms manufacturer's customer may accomplish the fold at the front end of the detacher using a trombone folder. The pasted pocket can be accomplished via a hot melt adhesive pattern and the return envelope can be created by the model 4200 forms processing equipment of Moore Business Forms, Inc. ("MBF").

In the preferred use of the form by the manufacturer's customer, the customer images part 2 with variable information using a non-impact printer, then takes the printout to a detacher, equipped with collator infeed kit and trombone folder. Part 1 is loaded from the side, passed through the trombone folder, folded at the perf 28 between the double row punching 30, 32, and loaded into the bottom infeed collator. Part 2 is loaded into the top collator, printed side down. The web plies now have become three in number, with the narrow intermediate web portion for forming the front of the return envelope "sandwiched" between the wider plies which will form the front and back of the outgoing envelope.

The collated set is trimmed, detached, and conveyed to a heat sealer. The heat seal adhesive forms the return envelope, and seals the two parts together.

Figure 6:
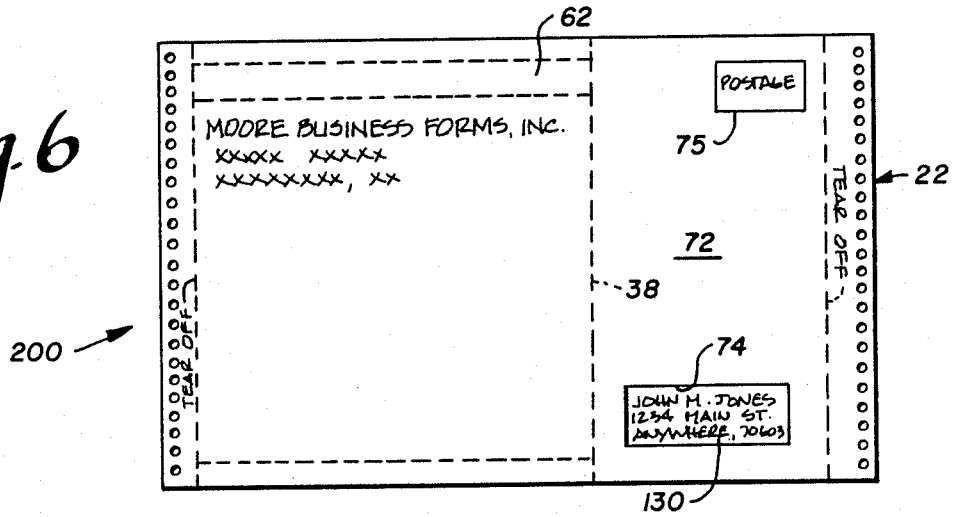
FIG. 6 is a front elevation view of an outgoing mailer of the present invention.
Figure 7:
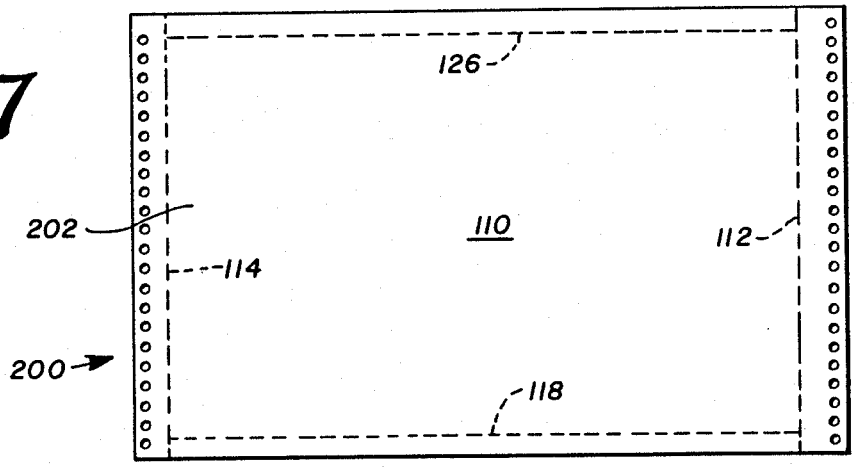
FIG. 7 is a rear elevation view thereof.

The recipient opens the document 200 (FIGS. 6 and 7) by removing both vertical margins along the respective perforation lines, and peeling the top sheet away from the bottom sheet. The return envelope is made ready for use by removing the windowed section 72 at the perf 38, removing the top and bottom stubs, and removing the chip 60 opposite the rewettable glue, wetting and folding over the flap 62 having that glue and sealing the return envelope (after putting in contents such as a check and/or a return stub, etc., which may include one or more portions of the discard sections 72 and 202).

It is a basic goal of the invention to assure that opening and/or removal perforations are within tolerances so that opening can be achieved with relative ease, and that the document is not damaged. In order to assure that the objective is met, the heat seal connection that the user needs to peel apart preferably is made of dots, rather than continuous lines, on the first part 10 In this manner, critical matches of respective perforations between the three respective plies of the outgoing mailer are not required. The rows of dots of adhesive which removably secure the inner side of the front of the outgoing envelope to the inner side of the rear of the outgoing envelope provide weaker attachment than do the lines of the squared-U shaped arrangement of adhesive which secures the two plies of part 1 to one another to provide the pocket of the return envelope, practically eliminating the chance that a user will inappropriately delaminate the plies when opening the outgoing envelope.

Any horizontal perforation lines which, in the end, are not used, can be omitted. For instance, the upper and lower marginal strips are preferably removed from the return envelope in order to create an envelope of an accepted standard size for U.S. Postal Service delivery, a factor which is not important when delivery is going to be accomplished by other means. Removal of these stubs does remove from the return envelope exposed adhesive residue from the delamination of parts 1 and 2, and such removal will be helpful anytime the return envelopes are to be processed through automated mail-handling equipment.

Of course, the upper and lower margin-creating perforations could be carried onto the discard panel 72 so that the user could conventionally open the outgoing envelope by tearing off top and bottom as well as left and right marginal strips, in accordance with correspondingly-revised printed instructions.

It should now be apparent that the two-part mailer with top-opening return envelope as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. Formstock for a two-part mailer with a top-opening return envelope, comprising:

a first part comprising a first web of flexible sheet material having an outer, front face and an inner, rear face, a longitudinally-running left edge and a longitudinally-running right edge; said first web having a length corresponding to that of at least one said mailer, each mailer-length thereof being delimited by upper and lower transverse lines of weakness corresponding to upper and lower edges of the respective said mailer, and said first web having a width which is less than twice as wide as the respective said mailer; and a second part comprising a second web of flexible sheet material having an inner, front face and an outer, rear face, a longitudinally-running left edge and a longitudinally-running right edge; said second web having a length corresponding to that of at least one said mailer, each mailer-length thereof being delimited by upper and lower transverse lines of weakness corresponding to upper and lower edge of the respective said mailer, and said second web having a width which is as wide as the respective said mailer;

said first web further including means defining a first intermediate line of weakness running between said upper and lower transverse lines of weakness at a location which divides each mailer-length of said first web into two connected panels including a potential outgoing envelope front panel which is as wide as said second web, and a potential return envelope front panel which is substantially narrower than said potential outgoing envelope front panel;

said first web further including means defining a second intermediate line of weakness running between said upper and lower transverse lines of weakness at a location which divides each mailer-length of said potential outgoing envelope front panel into two connected panels including a potential return envelope rear panel which is contiguous with said first intermediate line of weakness, and, laterally adjacent to said potential return envelope rear panel, a potential outgoing envelope window, aperture panel;

said first web further including in each said potential outgoing envelope window aperture panel one or more window apertures;

said second web further including, located more medially than, but adjacent, said left and right edges thereof, a longitudinally-running left-marginal line of weakness which defines with said left edge of said second web a left marginal strip for each mailer-length increment of said second web, and a longitudinally-running right-marginal line of weakness which defines with said right edge of said second web a right marginal strip of each mailer-length increment of said second web;

said first web being foldable along said first intermediate line of weakness to provide a two-ply structure in which, in each mailer-length increment, the respective said potential return envelope front panel facially confronts the respective said potential return envelope rear panel;

said first web further including, located more medially than one said longitudinally-running edge thereof on each said potential outgoing envelope front panel, a longitudinally-running first-marginal line of weakness which defines with said one edge a first marginal strip which is substantially as wide as one of said left and right marginal strips of said second web;

said first web further including, located equal distances transversally of and parallel to said first intermediate line of weakness, respectively on each said potential outgoing envelope front panel and on each said potential return envelope front panel, longitudinally-running second and longitudinally-running third potentially marginal lines of weakness which, upon folding of said first web along said first intermediate line of weakness are superimposable in facial confrontation to provide a two-ply marginal strip means laterally opposed to said first marginal strip of said first web;

said first web being provided with a squared U-shaped pattern of adhesive stripping on each mailer-length increment of said inner, rear face thereof, on one of said potential return envelope front and rear panels thereof for defining; when adhered to the other of said potential return envelope rear and front panels thereof a return envelope pocket having one transversally-running potentially open edge;

said first web being provided with a longitudinally-running first line of adhesive on said first marginal strip thereof on said inner, rear face thereof, and a longitudinally-running second line of adhesive on said two-ply marginal strip means on said outer, front face thereof, laterally between said first intermediate line of weakness and third longitudinally-running potentially marginal line of weakness, whereby said first web, when folded into a two-ply condition along said first intermediate line of weakness, may have said first marginal strip thereof and said two-ply marginal strip means respectively registered with and secured to respective said marginal strips of said second web on said inner, front face of said second web to thereby provide composite left and right marginal strips;

said first web being further provided on each mailer-length increment thereof, adjacent said upper and lower transverse lines of weakness thereof, respectively above and below the respective said squared U-shaped pattern of adhesive, with respective transversally extending upper and lower patterns of peel-permitting adhesive disposed partially on each potential outgoing envelope window aperture panel on said inner, rear face of said first web and partially on each potential return envelope front panel on said outer, front face of said first web; and said second web, on said inner, front face thereof, being provided on each mailer-length increment thereof with first and second fields adapted for receipt of variably printed information, one of which is situated to be framed by said window aperture when said first marginal strip and said two-ply marginal strip means of said first web, when folded on said first intermediate line of weakness is registered with and secured to respective of said marginal strips of said second web on said inner, front face of said second web, whereby, after said first web has been folded along said first intermediate line of weakness and registered and adhered to said second web by said longitudinally-running first and second lines of adhesive, and both said squared U-shaped patterns of adhesive stripping and said transversally-extending patterns of peel-permitting adhesive have been activated, with a variably-printed send-to address provided in one said field on each mailer-length increment of said second web and a resulting composite of said first and second webs has been severed along said upper and lower transverse lines of weakness into individual mailers structurally incorporating respective return envelopes, mailer-length increments of said second web may be peeled from mailer-length increments of said first web to expose outer, front faces of respective potential return envelopes.

2. The mailer formstock of claim 1, wherein:

on each mailer-length increment of said first web, said potential return envelope front panel is pre-printed on said outer, front face of said first web, with a return envelope send-to address.

3. The mailer formstock of claim 1, further including:

glue flap means provided on each mailer-length increment of said first web for sealing the respective open edge of the respective said return envelope.

4. The mailer formstock of claim 3, further including:

a pair of correspondingly located rows of alignable sprocket holes respectively formed in said first marginal strip of said first web and one of said left and right marginal strips of said second web; and a trio of correspondingly located rows of alignable sprocket holes respectively formed in said two-ply marginal strip means and the other of said right and left marginal strips of said second web.

5. The mailer formstock of claim 4, wherein:

said longitudinally-running first and second lines of adhesive, said squared U-shaped patterns of adhesive stripping and said transversally-extending patterns of peel permitting adhesive are made of hot-melt glue.

6. The mailer formstock of claim 5, wherein:

said glue flap means comprises a fold-over glue flap provided with a strip of rewettable glue.

7. A two-part mailer with a top-opening return envelope, comprising:

a first part comprising a first web of flexible sheet material having an outer, front face and an inner, rear face, a longitudinally-running left edge and a longitudinally-running right edge; said first web having a length corresponding to that of said mailer, said mailer length thereof being delimited by upper and lower transverse lines of weakness corresponding to upper and lower edges of said mailer, and said first we having a width which is less than twice as wide as said mailer; and a second part comprising a second web of flexible sheet material having an inner, front face and an outer, rear face, a longitudinally-running left edge and a longitudinally-running right edge; said second web having a length corresponding to that of said mailer, said mailer length thereof being delimited by upper and lower transverse lines of weakness corresponding to upper and lower edges of said mailer, and said second web having a width which is as wide as said mailer;

said first web further including means defining a first intermediate line of weakness running between said upper and lower transverse lines of weakness at a location which divides said first web into two connected panels including an outgoing envelope front panel which is as wide as said second web, and a potential return envelope front panel which is substantially narrower than said outgoing envelope front panel said first web further including means defining a second intermediate line of weakness running between said upper and lower transverse lines of weakness at a location which divides said mailer-length of said outgoing envelope front panel into two connected panels including a potential return envelope rear panel which is contiguous with said first intermediate line of weakness, and, laterally adjacent to said potential return envelope rear panel, an outgoing envelope window aperture panel;

said first web further including in said outgoing envelope window aperture panel one or more window apertures:

said second web further including, located more medially than, but adjacent, said left and right edges thereof, a longitudinally-running left-marginal line of weakness which defines with said left edge of said second web a left marginal strip for said second web, and a longitudinally-running right-marginal line of weakness which defines with said right edge of said second web a right marginal strip of said second web;

said first web being folded along said first intermediate line of weakness to provide a two-ply structure in which said potential return envelope front panel facially confronts said potential return envelope rear panel;

said first web further including, located more medially than one said longitudinally-running edge thereof on said outgoing envelope front panel, a longitudinally-running first-marginal line of weakness which defines with said one edge a first marginal strip which is substantially as wide as one of said left and right marginal strips of said second web;

said first web further including, located equal distances transversally of and parallel to said first intermediate line of weakness, respectively on said outgoing envelope front panel and on said potential return envelope front panel, longitudinally-running second and longitudinally-running third marginal lines of weakness which, due to folding of said first web along said first intermediate line of weakness are superimposed in facial confrontation to provide a two-pl marginal strip means laterally opposed to said first marginal strip of said first web;

said first web being provided with a squared U-shaped pattern of adhesive stripping on said inner, rear face thereof, on one of said potential return envelope front and rear panels thereof and adhered to the other of said potential return envelope rear and front panels thereof for defining a return envelope pocket having one transversally running potentially open edge;

said first web being provided with a longitudinally-running first line of adhesive on said first marginal strip thereof on said inner, rear face thereof, and a longitudinally-running second line of adhesive on said two-ply marginal strip means on said outer, front face thereof, laterally between said first intermediate line of weakness and third longitudinally-running potentially marginal line of weakness, whereby said first web has said first marginal strip thereof and said two-ply marginal strip means respectively registered with and secured to respective said marginal strips of said second web on said inner, front face of said second web to thereby provide composite left and right marginal strips;

said first web being further provided adjacent said upper and lower transverse lines of weakness thereof, respectively above and below the respective said squared U-shaped pattern of adhesive, with respective transversally extending upper and lower patterns of peel-permitting adhesive disposed partially on each outgoing envelope window aperture panel on said inner, rear face of said first web and partially on each potential return envelope front panel on said outer, front face of said first web; and said second web, on said inner, front face thereof, being provided with first and second fields of variably printed information, one of which is framed by said window aperture whereby said second web may be peeled from said first web to expose the outer, front face of the potential return envelope.

8. The mailer of claim 7, wherein:

on said first web, said potential return envelope front panel is pre-printed on said outer, front face of said first web, with a return envelope send-to address.

9. The mailer of claim 7, further including:

glue flap means provided on said first web for sealing the respective open edge of said return envelope.

10. The mailer of claim 9, further including:

a pair of correspondingly located rows of alignable sprocket holes respectively formed in said first marginal strip of said first web and one of said left and right marginal strips of said second web; and a trio of correspondingly located rows of alignable sprocket holes respectively formed in said two-ply marginal strip means and the other of said right and left marginal strips of said second web.

11. The mailer of claim 10, wherein:

said longitudinally-running first and second lines of adhesive, said squared U-shaped patterns of adhesive stripping and said transversally-extending patterns of peel permitting adhesive are made of hot-melt glue.

12. The mailer of claim 11, wherein:

said glue flap means comprises a fold-over glue flap provided with a strip of rewettable glue.

13. A method for providing a two-part mailer with a top opening return envelope, comprising:

providing a first part comprising a first web of flexible sheet material having an outer, front face and an inner, rear face, a longitudinally-running left edge and a longitudinally-running right edge; said first web having a length corresponding to that of at least one said mailer, each mailer-length thereof being delimited by upper and lower transverse lines of weakness corresponding to upper and lower edges of the respective said mailer, and said first web having a width which is less than twice as wide as the respective said mailer; and providing a second part comprising a second web of flexible sheet material having an inner, front face and an outer, rear face, a longitudinally-running left edge and a longitudinally-running right edge; said second web having a length corresponding to that of at least one said mailer, each mailer-length thereof being delimited by upper and lower transverse lines of weakness corresponding to upper and lower edges of the respective said mailer, and said second web having a width which is as wide as the respective said mailer;

said first web being further provided with a first intermediate line of weakness running between said upper and lower transverse lines of weakness at a location which divides each mailer-length of said first web into two connected panels including a potential outgoing envelope front panel which is as wide as said second web, and a potential return envelope front panel which is substantially narrower than said potential outgoing envelope front panel;

said first web being further provided with a second intermediate line of weakness running between said upper and lower transverse lines of weakness at a location which divides each mailer-length of said potential outgoing envelope front panel into two connected panels including a potential return envelope rear panel which is contiguous with said first intermediate line of weakness, and, laterally adjacent to said potential return envelope rear panel, a potential outgoing envelope window aperture panel;

said first web being further provided in each said potential outgoing envelope window aperture panel with one or more window apertures;

said second web being further provided, located more medially than, but adjacent, said left and right edges thereof, with a longitudinally-running left-marginal line of weakness which defines with said left edge of said second web a left marginal strip for each mailer-length increment of said second web, and a longitudinally-running right-marginal line of weakness which defines with said right edge of said second web a right marginal strip of each mailer-length increment of said second web;

said first web being foldable along said first intermediate line of weakness to provide a two-ply structure in which, in each mailer-length increment, the respective said potential return envelope front panel facially confronts the respective said potential return envelope rear panel;

said first web being further provided, located more medially than one said longitudinally-running edge thereof on each said potential outgoing envelope front panel, with a longitudinally-running first-marginal line of weakness which defines with said one edge a first marginal strip which is substantially as wide as one of said left and right marginal strips of said second web;

said first web being further provided, located equal distances transversally of and parallel to said first intermediate line of weakness, respectively on each said potential outgoing envelope front panel and on each said potential return envelope front panel, with longitudinally-running second and longitudinally-running third potentially marginal lines of weakness which, upon folding of said first web along said first intermediate line of weakness are superimposable in facial confrontation to provide a two-ply marginal strip means laterally opposed to said first marginal strip of said first web;

said first web being provided with a squared U-shaped pattern of adhesive stripping on each mailer-length increment of said inner, rear face thereof, on one of said potential return envelope front and rear panels thereof for defining, when adhered to the other of said potential return envelope rear and front panels thereof a return envelope pocket having one transversally-running potentially open edge;

said first web being provided with a longitudinally-running first line of adhesive on said first marginal strip thereof on said inner, rear face thereof, and a longitudinally-running second line of adhesive on said two-ply marginal strip means on said outer, front face thereof, laterally between said first intermediate line of weakness and third longitudinally-running potentially marginal line of weakness, whereby said first web, when folded into a two-ply condition along said first intermediate line of weakness, may have said first marginal strip thereof and said two-ply marginal strip means respectively registered with and secured to respective said marginal strips of said second web on said inner, front face of said second web to thereby provide composite left and right marginal strips;

said first web being further provided on each mailer-length increment thereof, adjacent said upper and lower transverse lines of weakness thereof, respectively above and below the respective said squared U-shaped pattern of adhesive, with respective transversally extending upper and lower patterns of peel-permitting adhesive disposed partially on each potential outgoing envelope window aperture panel on said inner, rear face of said firs web and partially on each potential return envelope front panel on said outer, front face of said first web; and said second web, on said inner, front face thereof, being provided on each mailer-length increment thereof with first and second fields adapted for receipt of variably printed information, one of which is situated to be framed by said window aperture when said first marginal strip and said two-ply marginal strip means of said first web, when folded on said first intermediate line of weakness is registered with and secured to respective of said marginal strips of said second web on said inner, front face of said second web;

variably-printing a send-to address provided in one said field on each mailer-length increment of said second web;

folding said first web along said first intermediate mediate line of weakness and registering and adhering said folded first web to said second web by said longitudinally-running first and second lines of adhesive;

activating both said squared U-shaped patterns of adhesive stripping and said transversally-extending patterns of peel-permitting adhesive; and severing a resulting composite of said first and second webs along said upper and lower transverse lines of weakness into individual mailers structurally incorporating respective return envelopes, whereby mailer-length increments of said second web may be peeled from mailer-length increments of said first web to expose outer, front faces of respective potential return envelopes.

14. The method of claim 13, further including:

on each mailer-length increment of said first web, pre-printing said potential return envelope front panel on said outer, front face of said first web, with a return envelope send-to address.

15. The method of claim 13, further including:

providing a glue flap on each mailer-length increment of said first web for sealing the respective open edge of the respective said return envelope.

16. The method of claim 15, further including:

providing a pair of correspondingly located rows of alignable sprocket holes respectively formed in said first marginal strip of said first web and one of said left and right marginal strips of said second web; and providing a trio of correspondingly located rows of alignable sprocket holes respectively formed in said two-ply marginal strip means and the other of said right and left marginal strips of said second web.

17. The method of claim 16, wherein:

said longitudinally-running first and second lines of adhesive, said squared U-shaped patterns of adhesive stripping and said transversally-extending patterns of peel permitting adhesive are made of hot-melt glue.

18. The method of claim 17, wherein:

said glue flap means comprises a fold-over glue flap provided with a strip of rewettable glue.

* * * * *